United States Patent [19]

Kund

[11] 4,334,726

[45] Jun. 15, 1982

[54] BONDING DEVICE

[75] Inventor: August Kund, Glendale, Calif.

[73] Assignee: Communications Technology Corporation, Los Angeles, Calif.

[21] Appl. No.: 148,811

[22] Filed: May 12, 1980

[51] Int. Cl.[3] ..... H01R 11/10

[52] U.S. Cl. ..... 339/14 L; 339/95 R

[58] Field of Search ..... 339/13, 14 R, 14 L, 339/95 R, 97 P

[56] References Cited

U.S. PATENT DOCUMENTS 3,194,877 7/1965 Collier ..... 339/95 R 3,828,298 8/1974 Schumacher ..... 339/14 R

FOREIGN PATENT DOCUMENTS 2354646 1/1978 France ..... 339/14 R

*Primary Examiner*—Joseph H. McGlynn

[57] ABSTRACT

A bonding device for an electrical cable having a plurality of conductors enclosed by an inner metal sheath which is enclosed by an outer plastic sheath. The bonding device is a U-shaped metal plate having first and second arms joined by a center section, with the first arm having a central curved section for wrapping around the outer sheath of the cable and the second arm having a central curved section for wrapping around the inner sheath of the cable. The outer end of the first arm may be fastened to the center section to clamp the outer sheath in the bonding device. The outer end of the second arm may be fastened to the center section and to a grounding conductor or other member as desired, to make electrical contact with the inner sheath. Openings with inwardly directed points are provided in the central curved sections of the arms to enhance engagement with the sheaths, and elongate slots are provided in the arms to reduce the force required to effect clamping.

3 Claims, 6 Drawing Figures

BONDING DEVICE

BACKGROUND OF THE INVENTION

This invention relates to a bonding device for making an electrical connection to a conducting sheath in an electrical cable, and in particular to a new and improved one-piece bonding device.

The bonding device of the invention is intended for use with an electrical cable having a plurality of conductors enclosed by an inner metal sheath which in turn is enclosed by an outer electrical insulating sheath. Such cables are widely used in the telephone industry, one such cable being the NEX type, and the bonding device of the present invention is especially adapted for use with such type cables.

A variety of configurations have been provided for making connections to the shield of a cable. Two such devices are shown in U.S. Pat. No. 3,915,540 and No. 3,963,299. Additional cable shield bonding devices are shown in copending applications of Mangrobang et al, Ser. No. 066,780, filed Aug. 14, 1979, and Kund, Ser. No. 125,586, filed Feb. 28, 1980, both assigned to the same assignee as the present application. These various prior connecting devices are suitable for various uses but are not so satisfactory for other uses.

It is an object of the present invention to provide a new and improved bonding device which is made in one piece and which can be utilized to provide a strong mechanical grip on the outer insulating sheath of a cable and also provide for good electrical contact with the inner metal sheath of the cable and providing for connecting a grounding wire to the bonding device or for connecting the bonding device to a terminal or the like.

Other objects, advantages, features and results will more fully appear in the course of the following description.

SUMMARY OF THE INVENTION

A bonding device for an electrical cable having a plurality of conductors enclosed by an inner metal sheath which in turn is enclosed by an outer electrical conducting sheath. The bonding device comprises a single generally U-shaped metal plate having first and second arms joined by a center section, with the first arm having a central curved section for wrapping around the outer sheath and with the second arm having a central curved section for wrapping around the inner sheath. Means are provided for fastening the ends of each arm to the center section. Preferably each arm includes openings with inwardly directed points for gripping the sheaths and one or more slots so that the arms are easily compressed onto the center section.

DESCRIPTION OF THE PREFERRED EMBODIMENT

Figure 1:
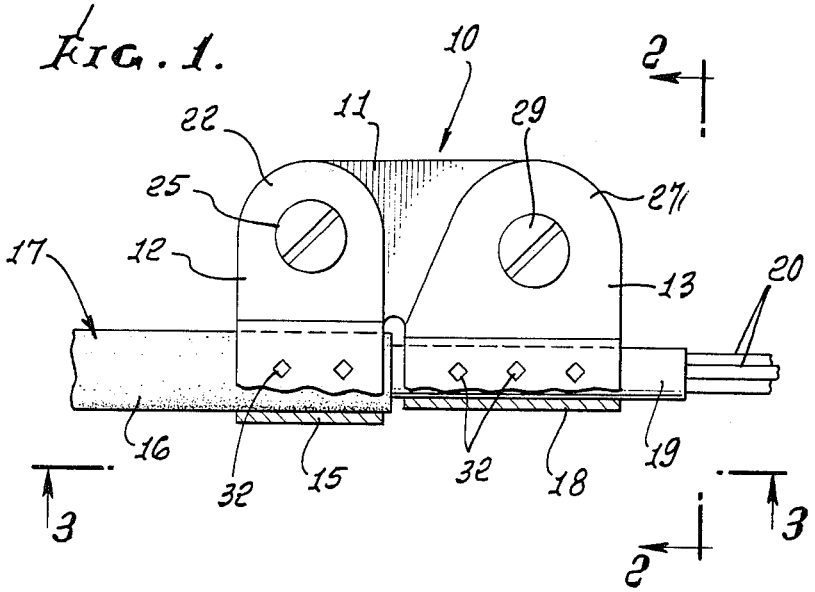
FIG. 1 is a side view of a bonding device mounted on a cable and incorporating the presently preferred embodiment of the invention.
Figure 2:
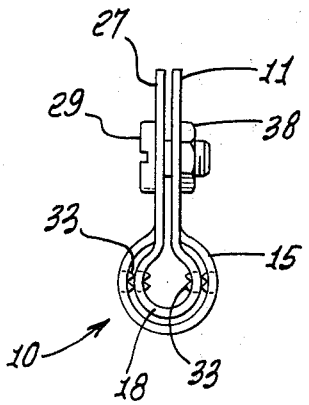
FIG. 2 is an end view of the bonding device of FIG. 1 taken along the line 2—2.
Figure 3:
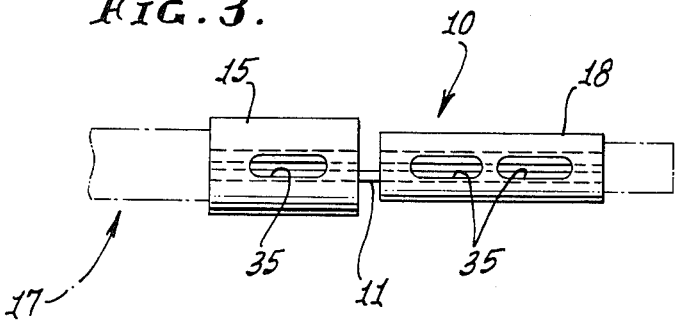
FIG. 3 is a bottom view of the bonding device of FIG. 1 taken along the line 3—3.

The bonding device 10 is made of a single piece of sheet metal, typically quarter hard brass. It is generally U-shaped, with a center section 11 joining first and second arms 12, 13. The arm 12 has a central curved section 15 which is adapted for wrapping around the outer insulating sheath 16 of an electrical cable 17. The arm 13 has a similar central section 18 adapted for wrapping around the inner metal sheath 19 of the cable 17. Typically the cable 17 has a plurality of conductors 20 enclosed within the metal sheath 19 which in turn is enclosed in the insulating sheath 16.

Means are provided for fastening the outer end 22 of the arm 12 to the center section 11 of the bonding device. Typically a threaded opening 24 is provided in the center section 11 for receiving a screw 25 which passes through a clearance opening in the end 22 of the arm 12. Means are provided for fastening the outer end 27 of the arm 13 to the center section 11 or to a terminal block or other unit as desired. Typically a clearance opening 28 is provided in the center section 11 with a corresponding opening in the end 27 of the arm 13 for a screw 29.

Preferably, openings 32 are pierced in the curved central sections 15 and 18 so as to leave inwardly directed points 33 for gripping the sheaths when the bonding device is clamped onto the respective sheaths by the fastening means.

Also, it is preferable to provide elongate slots 35 in the central curved sections 15, 18, with the longitudinal axis of the slots parallel to the axis of the cable 17. These slots are positioned at the mid point of the central curved sections to provide regions of reduced strength so that the bonding device is more easily clamped about the cable sheaths.

Figure 4:
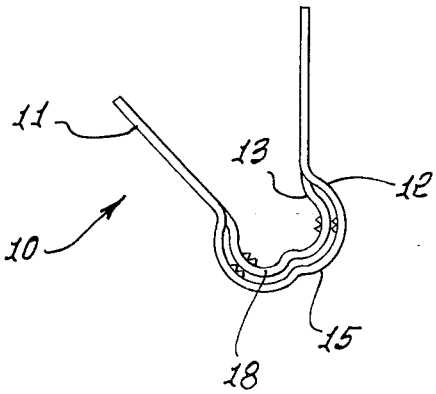
FIG. 4 is a view from the left end of the bonding device of FIG. 1 showing the bonding device prior to clamping the cable therein.
Figure 5:
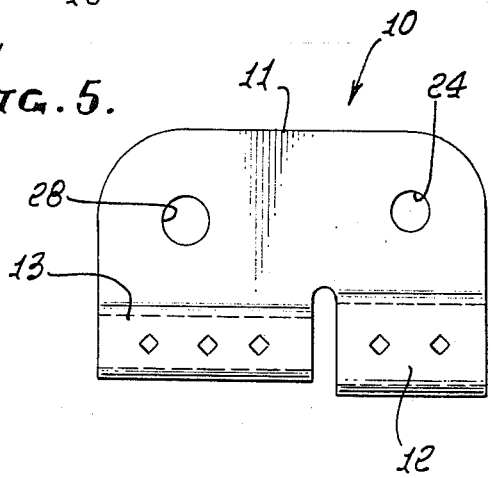
FIG. 5 is a view of the bonding device of FIG. 1 taken from the opposite side.

The bonding device is delivered ready for use in the configuration shown in FIG. 4. After a portion of the outer sheath 16 has been removed to expose the inner sheath 19 and a portion of the inner sheath 19 has been removed to expose the conductors 20, the bonding device is positioned on the cable as shown in FIG. 1. Then the end 22 of the arm 12 is brought toward the center section 11 and is clamped in place, as by inserting the screw 25 with the threaded section of the screw entering the threaded opening 24.

Figure 6:
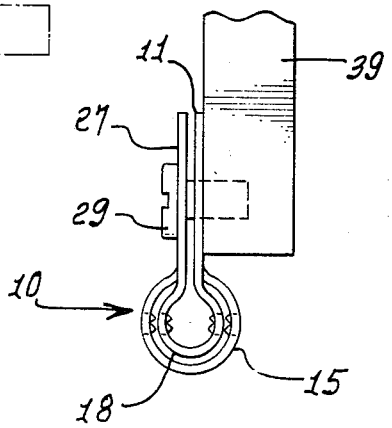
FIG. 6 is a view similar to that of FIG. 2 showing a typical fastening embodiment.

The arm 13 may be clamped about the inner sheath 19, as by the screw 29 and a nut 38. In a typical installation, the bonding device may be directly attached to a terminal or the like 39 by means of the screw 29, as shown in FIG. 6. Two of the bonding devices may be joined together at the arms 13 and center sections 11 by the screw and nut, providing a connection between the conducting sheaths of two cables, typically in an in line configuration.

Fastening the arm 12 to the center section 11 by the screw 25 securely clamps the cable in the bonding device. Fastening the arm 13 to the center section 11 by means of the screw 29 provides a good electrical contact with the inner metal sheath of the cable, thus achieving the desired aim of a secure mechanical connection and a secure electrical connection with a one-piece bonding device.

The inner sheath of the cable may be a relatively thick metal layer or may be a relatively thin metal layer over a plastic layer. The outer sheath may be a single layer or may be a dual layer, typically a relatively thick outer layer and a relatively thin inner layer.

I claim:

1. A bonding device for an electrical cable having a plurality of conductors enclosed by an inner metal sheath which is enclosed by an outer electrical insulating sheath, comprising a generally U-shaped metal plate having first and second arms joined by a center section, with said first arm having a central curved section for wrapping around said outer sheath, and with said second arm having a central curved section for wrapping around said inner sheath, said first arm having a first opening therethrough adjacent the end of said first arm, said second arm having a second opening therethrough adjacent the end of said second arm, and said center section having third and fourth openings therethrough aligned with said first and second openings, respectively, with said first and third aligned openings adapted for receiving first fastening means for clamping said device onto said outer sheath and with said second and fourth aligned openings adapted for receiving second fastening means for clamping said device onto said inner sheath.

2. A bonding device as defined in claim 1 wherein said central curved section of said first arm has a plurality of openings therethrough with inwardly projecting points for gripping said outer sheath; and said central curved section of said second arm has a plurality of openings therethrough with inwardly projecting points for gripping said inner sheath.

3. A bonding device as defined in claim 2 including at least one elongate slot in each of said first and second arm central curved sections, with the longitudinal axis of said slots parallel to the axis of a cable placed in said central curved sections.

* * * * *